United States Patent [19]

Vogel

[11] Patent Number: 4,567,838

[45] Date of Patent: Feb. 4, 1986

[54] APPARATUS AND PROCESS FOR DROPPING FEED DOG AND LIFTING PRESSER FOOT SIMULTANEOUSLY

[75] Inventor: Peter Vogel, Steckborn, Switzerland

[73] Assignee: Fritz Gegauf Aktiengesellschaft Bernina-Nahmaschinenfabrik, Steckborn, Switzerland

[21] Appl. No.: 586,859

[22] Filed: Mar. 6, 1984

[30] Foreign Application Priority Data

Mar. 23, 1983 [CH] Switzerland ..... 1574/83

[51] Int. Cl.[4] ..... D05B 27/24; D05B 29/02

[52] U.S. Cl. ..... 112/237; 112/262.1; 112/314

[58] Field of Search ..... 112/237, 262.1, 323, 112/324, 314, 319, 121.11

[56] References Cited

U.S. PATENT DOCUMENTS

| | | | |
|---|---|---|---|
| 2,420,697 | 5/1947 | Best | 112/314 |
| 2,682,242 | 6/1954 | Palme et al. | 112/314 |
| 3,353,511 | 11/1967 | Marino | 112/237 |
| 3,611,961 | 10/1971 | Lopez | 112/121.11 |
| 3,777,686 | 12/1973 | Hage | 112/237 |
| 4,426,947 | 1/1984 | Marshall | 112/324 |

*Primary Examiner*—Werner H. Schroeder
*Assistant Examiner*—Andrew M. Falik
*Attorney, Agent, or Firm*—Birch, Stewart, Kolasch & Birch

[57] ABSTRACT

The lifting device (19) of the presser foot (21) of a sewing machine is operable through the use of an operating axle (18) and a toggle lever (20). The operating axle (18) is connected to a slide (15) capable of engaging and disengaging a coupling mechanism (10). The coupling mechanism (10) is arranged between the lifting device (6) of the feed dog (3) and the oscillating drive means (7) of the lifting device. During the lifting of the presser foot (21) by means of the toggle lever (20), the coupling pin (12) of the coupling mechanism (10) is simultaneously placed out of engagement with the driven oscillating lever (8) by means of the slide (15). Thus the drive of the lifting device (6) is interrupted, and a spring (13) pulls the feed dog (3) into its lowered position. Thus the manipulation of the sewing material is made possible without the feed dog presenting an obstacle.

4 Claims, 3 Drawing Figures

APPARATUS AND PROCESS FOR DROPPING FEED DOG AND LIFTING PRESSER FOOT SIMULTANEOUSLY

BACKGROUND AND SUMMARY OF THE INVENTION

The present invention relates to a process and apparatus for controlling the cloth feeder of a sewing machine.

As is known, an approximately rectangular movement is imparted to the cloth feeder of customary sewing machines during the sewing procedure, i.e. the cloth feeder is lifted from a low, ineffective position, upwardly past the needle plate, moved forward in the cloth feeding direction, then lowered below the needle plate, and finally moved back into the starting position. During this operation, the movements of the needle and of the cloth feeder are synchronized in such a way that the feeding of the sewing material takes place while the needle is in the uppermost zone of its upward movement. The cloth feeder thus projects beyond the working surface with the needle in the lifted position. Since the action of the cloth feeder is undesirable for performing certain objectives, for example for darning, embroidering, and the like, level-adjustable needle plates or cover plates have been proposed which take care of maintaining the cloth feeder, even in its lifted operating position, beneath the working plane and thus in an ineffective state. However, since the cloth feeder, when projecting above the working plane, also interferes with the correct positioning of the sewing material under the sewing site before initiating the sewing operation, or with other manipulations of the sewing material, different, manually operable devices have also become known, by means of which the cloth feeder can be lowered in each case. On the other hand, for positioning and/or manipulation of the sewing material, the presser foot must in each instance be lifted at least to such an extent (for example by hand or by knee manipulation) that it no longer exerts pressure on the sewing material. The unhindered shifting of the sewing material on the working surface thus makes it necessary in the conventional machines to operate, in addition to the device for lifting the presser foot, also the device for lifting the needle plate and/or for lowering the cloth feeder. This procedure is cumbersome and does not permit rapid working. Of course, analogous considerations apply after the lowering of the presser foot, when the cloth feeder must be returned to its operative position.

These disadvantages are avoided by the process of the present invention by providing that the cloth feeder, during the lifting of the presser foot by means of the operating element associated therewith, is simultaneously placed into its lowered position and, upon lowering of the presser foot, is again released for the lifting movement. Accordingly, a single operating step suffices for the simultaneous release of the working surface from the presser foot as well as from the cloth feeder.

The apparatus for conducting the present process, likewise forming the subject matter of the present invention, comprises a coupling mechanism between the presser foot lifting device and the lifting mechanism for the cloth feeder, which latter is acted upon along the lines of lowering the same, this coupling mechanism, upon operation of the lifting device along the lines of lifting the presser foot, simultaneously disengaging the lifting mechanism of the cloth feeder from its driving element and thus lowering the loaded (acted-upon) cloth feeder.

Due to this arrangement, the cloth feeder is, with certainty, lowered simultaneously upon lifting the presser foot by means of the lifting device and, conversely, upon the lowering of the presser foot by means of the lifting device, the coupling mechanism is again placed in readiness for coupling the lifting mechanism of the cloth feeder with its driving element.

Particularly suitable is an installation wherein the coupling mechanism, is operable by the operating element of the lifting device which is actuatable, for example, by a toggle lever and is, also by means of a separate, manual operating element not operable affecting the lifting device, for the activation and deactivation of the lifting mechanism for the cloth feeder. In such an installation the manual operating means customary in sewing machines for the direct lifting and lowering of the pressure foot does not affect the coupling mechanism.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
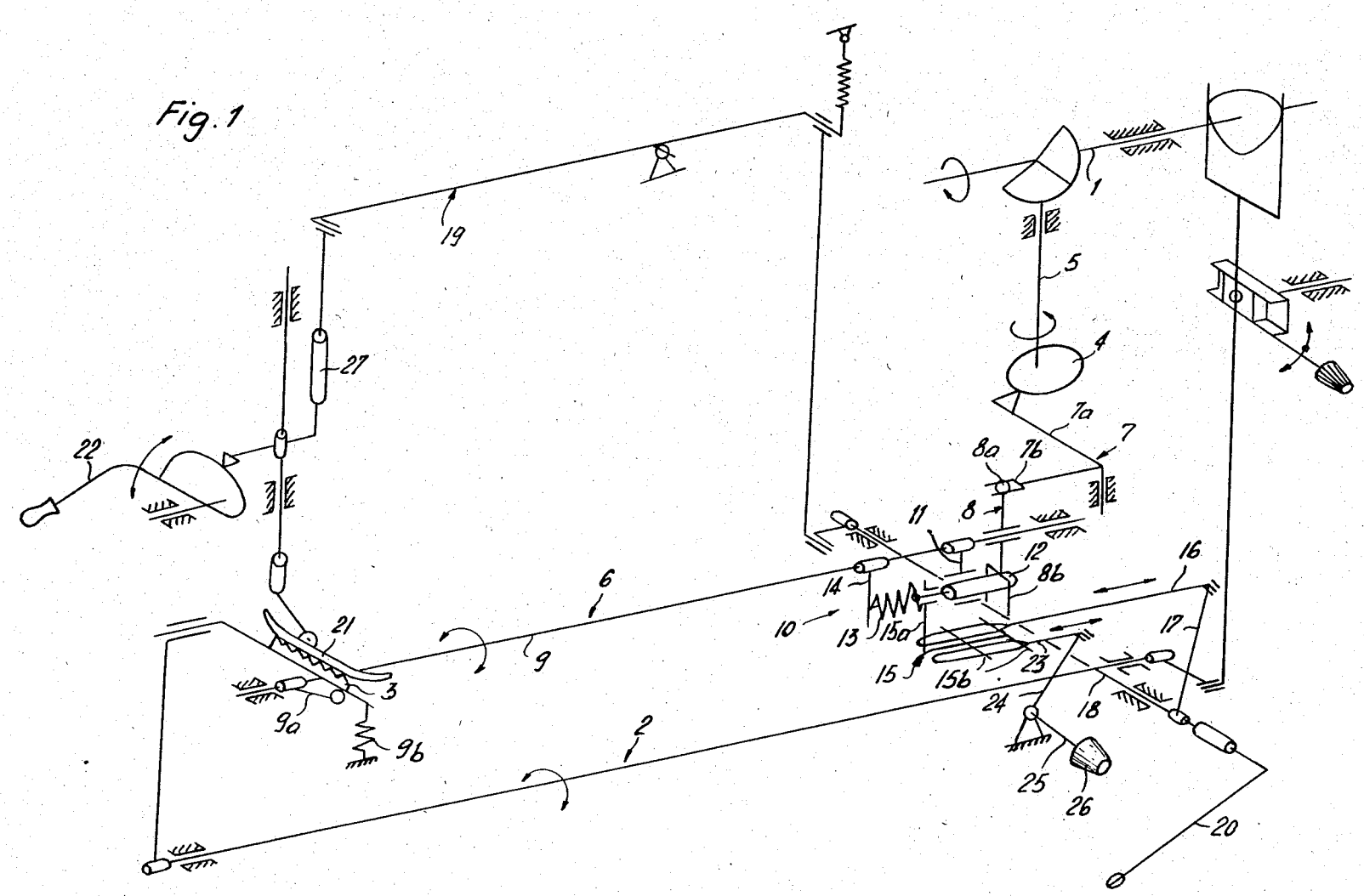
FIG. 1 shows a diagrammatic and schematic view of an apparatus for controlling the presser foot and the cloth feeder of a sewing machine with a coupling mechanism.

In FIG. 1, element 1 denotes the conventional stator shaft of a sewing machine, driven by means of an eccentric and a linkage, and a feeding mechanism 2 for the horizontal forward and backward movement of the cloth feeder or feed dog 3. The drive shaft 5, carrying a cam disk 4, for the lifting mechanism 6 for the vertical lifting of the cloth feeder 3 is drivable from the stator shaft 1. The cam disk 4 is scanned by an arm 7*a* of an elbow lever 7 supported to be swingable about a vertical axis. The other arm 7*b* of the elbow lever forms a fork which is engaged by one arm 8*a* of a two-armed oscillating lever 8 of a coupling mechanism 10. The oscillating lever is swingably supported on a shaft 9 of the lifting mechanism 6. A coupling pin 12 is mounted to be axially displaceable in a bore, oriented in parallel to the shaft 9, of a coupling head 11 fixed to this shaft 9. One end of this coupling pin 12, which end has a conical shape, is in operable cooperation with a corresponding recess in the other arm 8*b* of the swinging lever 8, whereas a spring 13 is supported on the other end of the pin, the other end of this spring resting, on a fishplate 14 affixed to the shaft 9. Furthermore, the last-mentioned end of the coupling pin 12 is engaged by a supporting arm 15*a*, projecting radially away from the pin, and extending into a slide 15 arranged in parallel to the pin 12. The slide 15 has two double-armed crossbars 15*b*.

The crossbar arms, projecting on one side of the slide, are guided in the longitudinal slot of a first guide arm 16 operatively connected to a rocking lever 17. This rocking lever 17 is nonrotationally affixed, at the other end thereof to a rotatably supported operating shaft 18 for the lifting device 19, which shaft passes at right angles to the shaft 9 through the column (not shown) of the machine. At the front face of the sewing machine, the operating shaft 18 is equipped with a knee-operable operating lever 20, by means of which the presser foot 21 can be lifted or lowered by the lifting device 19, in a conventional manner. As can be seen from FIG. 1, the presser foot 21 can also be directly lifted or lowered by means of the hand lever 22 customarily arranged on the sewing machine.

The crossbar arms 15*b* projecting on the other side of the slide are guided analogously in the longitudinal slot of a second guide arm 23, which in turn, is connected via a guide arm 24 with an operating axle 25 supported at the frontal side in the machine housing. This operating axle is provided with a turning knob 26.

It can be seen from the above description that the lifting device 6 for the cloth feeder 3 can be engaged and disengaged by way of the coupling mechanism 10, as will be described in greater detail below, via the operating axle 18 for the presser foot lifting device 19 as well as via the operating axle 25 serving for the separate manual lowering of the cloth feeder.

Figure 2:
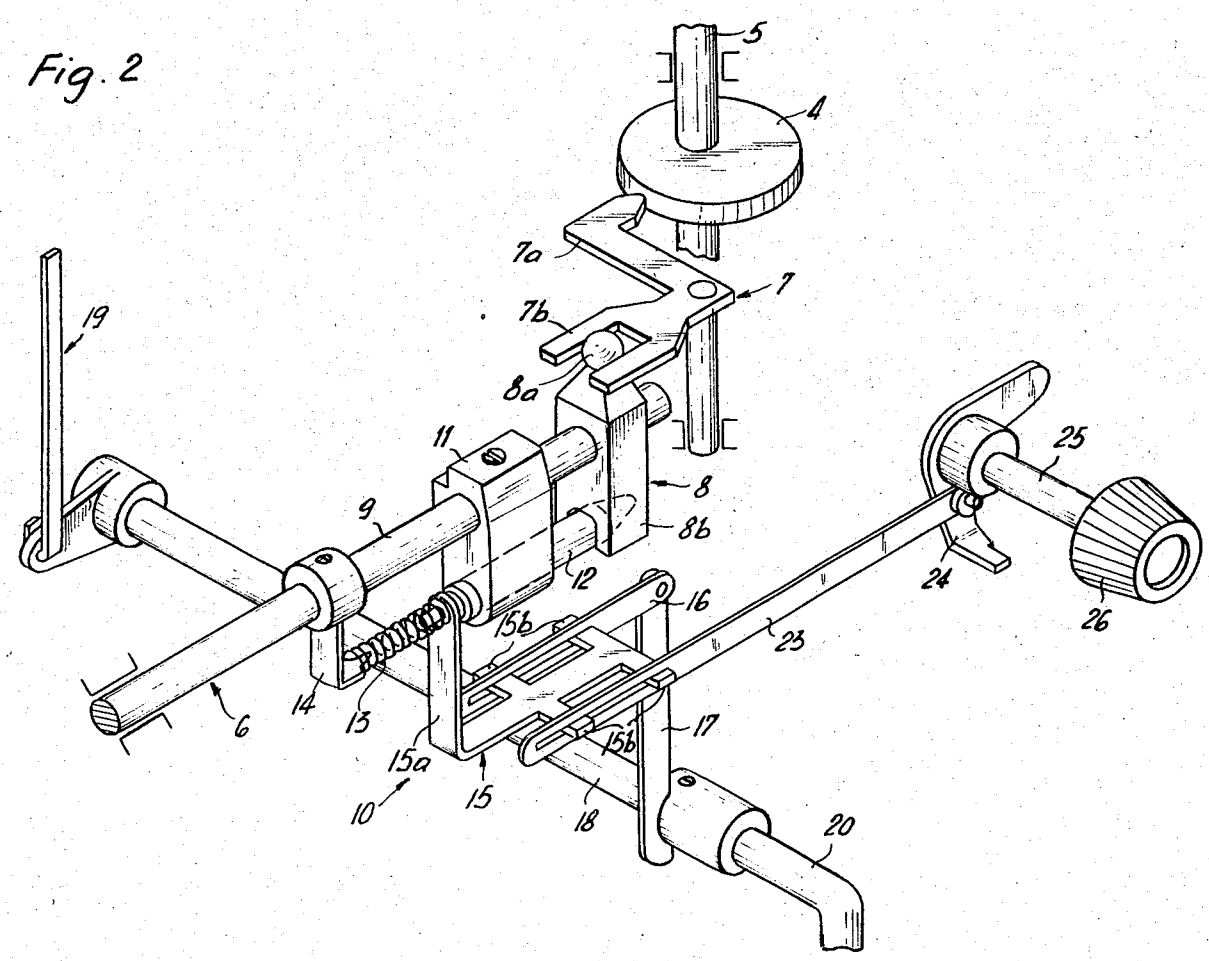
FIG. 2 shows in a diagrammatic view one example for the presser foot lifting device, the cloth feeder lifting mechanism, and the cloth feeder lowering mechanism, connected by way of the coupling mechanism, and in an engaged position, in accordance with FIG. 1.

FIG. 2 shows in a diagrammatic view the coupling mechanism with its various connections according to FIG. 1, in the engaged position. The spring 13 retains the pin 12 in engagement with the corresponding recess in the arm 8*b* of the rocking lever 8. This rocking lever 8, supported freely swinging on the shaft 9, is placed into a to and fro swinging movement when the shaft 5 is driven, by means of the cam disk 4 and the elbow lever 7. The coupling pin 12 transmits this oscillating motion to the coupling head 11, which in turn places the shaft 9 of the lifting mechanism 6 into corresponding rotary oscillation. This rotary oscillation effects, via the rocker arm indicated in FIG. 1 at 9*a* and subtending the cloth feeder 3, a lifting motion of the cloth feeder 3, which with the respective downward swing of the rocker arm 9*a*, is suitably lowered again, as shown in FIG. 1, with the aid of a spring 9*b*.

Figure 3:
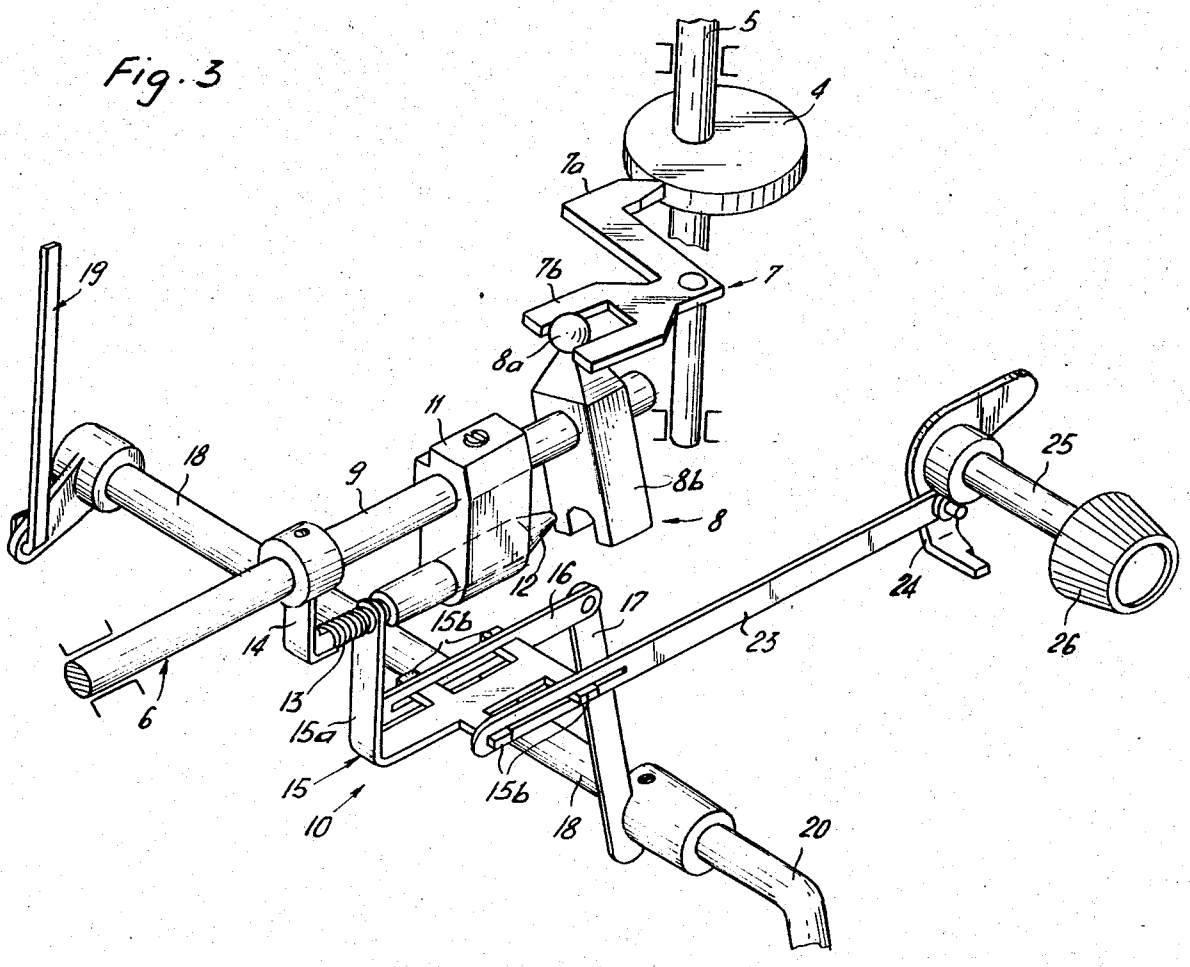
FIG. 3 shows a view analogous to FIG. 2, but in a disengaged position.

If the cloth feeder 3 is to be brought from the coupling position seen in FIG. 2, into its lowered position and is to be maintained therein, while the presser foot is simultaneously brought to its upper lifted position, a pivoting of the operating lever 20 (in the counterclockwise direction) is sufficient. The lever 17 pushes the guide arm 16 toward the left, as seen in the drawing, resulting, due to the bar arms 15*b* engaging in its longitudinal slot, in a corresponding displacement of the slide 15 and, with the tensioning of the spring 13, the displacement of the coupling pin 12 from the rocking lever 8. Accordingly, the moving connection between the reciprocating rocking lever 8 and the coupling head 11 and thus the shaft 9 is interrupted (FIG. 3). The spring 9*b* stressing the cloth feeder 3 maintains the cloth feeder 3 in its ineffective lowered position. However, at the same time, pivoting of the operating lever 20 by a corresponding turning of the operating shaft 18 by way of the lifting device 19 causes the presser foot 21 to lift. Thus, by a single operating motion of the lever 20, the sewing site on the needle plate of the sewing machine is cleared, and the sewing material can be freely moved without obstruction by the cloth feeder.

If, in the illustrated example, the lever 20 is moved back into its starting position, this entails, by a corresponding displacement of the lever 16 toward the right under the action of the spring 13, a concomitant displacement of the slide 15 and of the coupling pin 12. Because of its conical apex, the coupling pin 12 is positioned in correct register with the recess of the rocking lever 8 oscillating to and fro in front of the pin, so that the drive shaft 5 and the lifting mechanism 6 for the cloth feeder 3 are coupled again. At the same time, the presser foot 21 has likewise been lowered again by way of the lifting device 19.

As mentioned above, the presser foot 21 can be lifted by means of the manual lever 22, but also directly and without affecting the lifting mechanism of the cloth feeder 3. Because of the free play provided at 27 in the transmission linkage, a restricted upward urging of the presser foot 21 by the sewing material does not act on the lifting mechanism 19 so that this cannot lead to a decoupling of the lifting device 6 from its drive means. In contrast, the oscillating connection between the rocking lever 8 and the shaft 9 can also be interrupted by means of the turning knob 26, without any effect on the presser foot. By rotating the turn knob 26 (FIG. 2) in a counterclockwise direction up to a stop, for example, for the lever arm 24, the guide arm 23 pushes the slide 15, and accordingly the coupling pin 12, into a decoupled position by means of the bar arms 15*b* engaging in its longitudinal slot.

It is understood that, depending on the kind of construction of the sewing machine, any other coupling means releasably connecting the lifting device of the presser foot with the lifting mechanism for the cloth feeder can also be provided. The essential aspect is merely that they be capable of controlling the cloth feeder with respect to its reciprocating motion in such a way that the cloth feeder, by a single actuation of an operating element, can be lowered simultaneously with the lifting of the presser foot, and can only be placed again into operative connection with its lifting mechanism drive means upon the lowering of the presser foot.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for simultaneously dropping the feed dog and raising the pressure foot in a sewing machine containing a presser foot lifting device and its associated drive element and a lifting mechaism for the feed dog, which comprises providing a coupling mechanism between said presser foot lifting device and said lifting mechanism, said coupling mechanism, during the operation of said lifting device for lifting the presser foot, simultaneously decoupling said lifting mechanism for the feed dog from its drive element, thereby lowering the feed dog.

2. A process for simultaneously dropping the feed dog and lifting the presser foot by a single operating step on a sewing machine characterized by lifting said presser foot by means of an operating element associated therewith, decoupling a clutch between a feed lift eccentric and said feed dog during said lifting thereby causing said fee dog to fall to its lower position, upon lowering of said presser foot, said clutch is coupled again for transmitting lift motion to the feed dog, whereby a single operating step is effective to lower the feed dog below the working surface and raise a presser foot above a working surface.

3. An apparatus for simultaneously dropping the feed dog and raising the presser foot in a sewing machine containing a presser lifting device and its associated drive element and a lifting mechanism for the feed dog, which comprises providing a coupling mechanism between said presser foot lifting device and said lifting mechanism, said coupling mechanism, during the operation of said lifting device for lifting the presser foot, simultaneously decoupling said lifting mechanism for the feed dog from its drive element, thereby lowering the feed dog, said coupling mechanism comprises a slide member, a coupling pin member and an oscillating lever, said slide member being engaged with said coupling pin member, which in turn is in spring biased engagement with said oscillating lever, said slide member being operatively connected to a swingable operating lever for the lifting device of the presser foot, wherein the coupling pin member is brought into and out of engagement with said oscillating lever through the operation of said slide member, said oscillating lever, when engaged with said coupling pin member, transmitting the swinging motion imparted to the oscillating lever by the machine drive mechanism to the shaft of the lifting mechanism.

4. The apparatus of claim 3 wherein said slide member contains crossbar arm members which extend from both sides thereof, the arm member extending from one side being guided in the longitudinal slot of a first guide arm which is operatively connected to the lifting device, and the arm member extending from the other side being guided in the longitudinal slot of a second guide arm which is operative to engage and disengage, independent of the lifting device of the presser foot, said coupling mechanism connecting the lifting mechaism of the cloth feeder with the drive member thereof.

* * * * *